US005709365A

United States Patent [19]

Howard

[11] Patent Number: 5,709,365

[45] Date of Patent: Jan. 20, 1998

[54] ADJUSTABLE BOOK SUPPORT

[76] Inventor: Scott C. Howard, Box 9050, Hindman, Ky. 41822

[21] Appl. No.: 642,448

[22] Filed: May 3, 1996

[51] Int. Cl.[6] ..... A47B 97/04; A47G 1/16

[52] U.S. Cl. ..... 248/454; 248/447.2; 248/451

[58] Field of Search ..... 248/454, 447.1, 248/447.2, 448, 451, 460, 284.1, 286.1; 211/69.1

[56] References Cited

U.S. PATENT DOCUMENTS

| | | | |
|---|---|---|---|
| 198,634 | 12/1877 | Liles | 248/447.1 |
| 290,381 | 12/1883 | Wood | 248/452 |
| 834,553 | 10/1906 | Bartlett | 248/454 |
| 1,216,321 | 2/1917 | Inami | 248/447.2 X |
| 1,494,212 | 5/1924 | Bromley | 248/454 |
| 1,692,337 | 11/1928 | Forbes | 248/447.2 X |
| 2,661,569 | 12/1953 | Bargen | 248/451 |
| 3,097,444 | 7/1963 | Steiner | 248/454 |
| 3,341,166 | 9/1967 | Forrester | 248/448 |
| 3,408,032 | 10/1968 | Francis | 248/447.2 |
| 3,889,914 | 6/1975 | Torme | 248/451 X |
| 4,021,013 | 5/1977 | Wiersma | 248/447.2 X |
| 5,080,315 | 1/1992 | Tucker-Schafer | 248/454 X |
| 5,615,856 | 4/1997 | Simington | 248/454 X |

FOREIGN PATENT DOCUMENTS

| | | | |
|---|---|---|---|
| 334208 | 9/1936 | Italy | 248/447.2 |

*Primary Examiner*—Ramon O. Ramirez
*Assistant Examiner*—Stephen S. Wentsler

[57] ABSTRACT

The present invention relates to a book holding device which enables a user to read in bed without using their hands. In its broadest context, the present invention includes a book supporting platform to which a first and second arm assembly are pivotally attached. Each arm assembly is telescopically arranged to allow for the extension and retraction of the supporting platform. Furthermore, each of the arm assemblies includes a clamp at its distal end. The clamps allow the device robe secured to the backboard of a bed, thus allowing reading in a hands free manner.

1 Claim, 3 Drawing Sheets

FIG 5
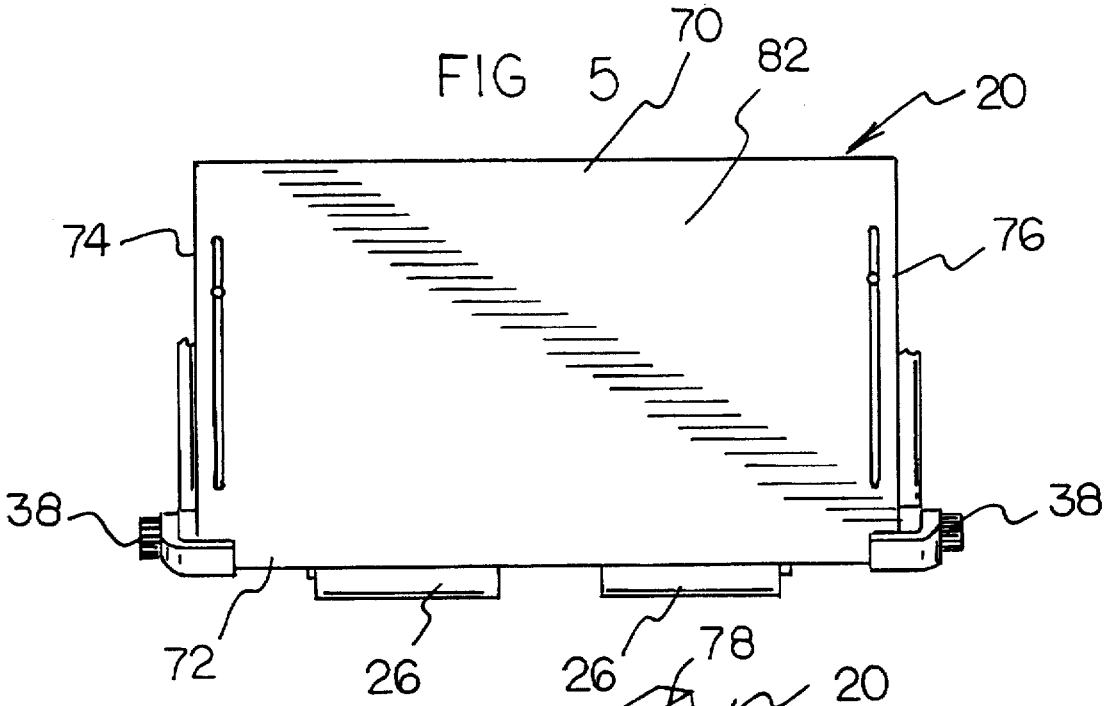
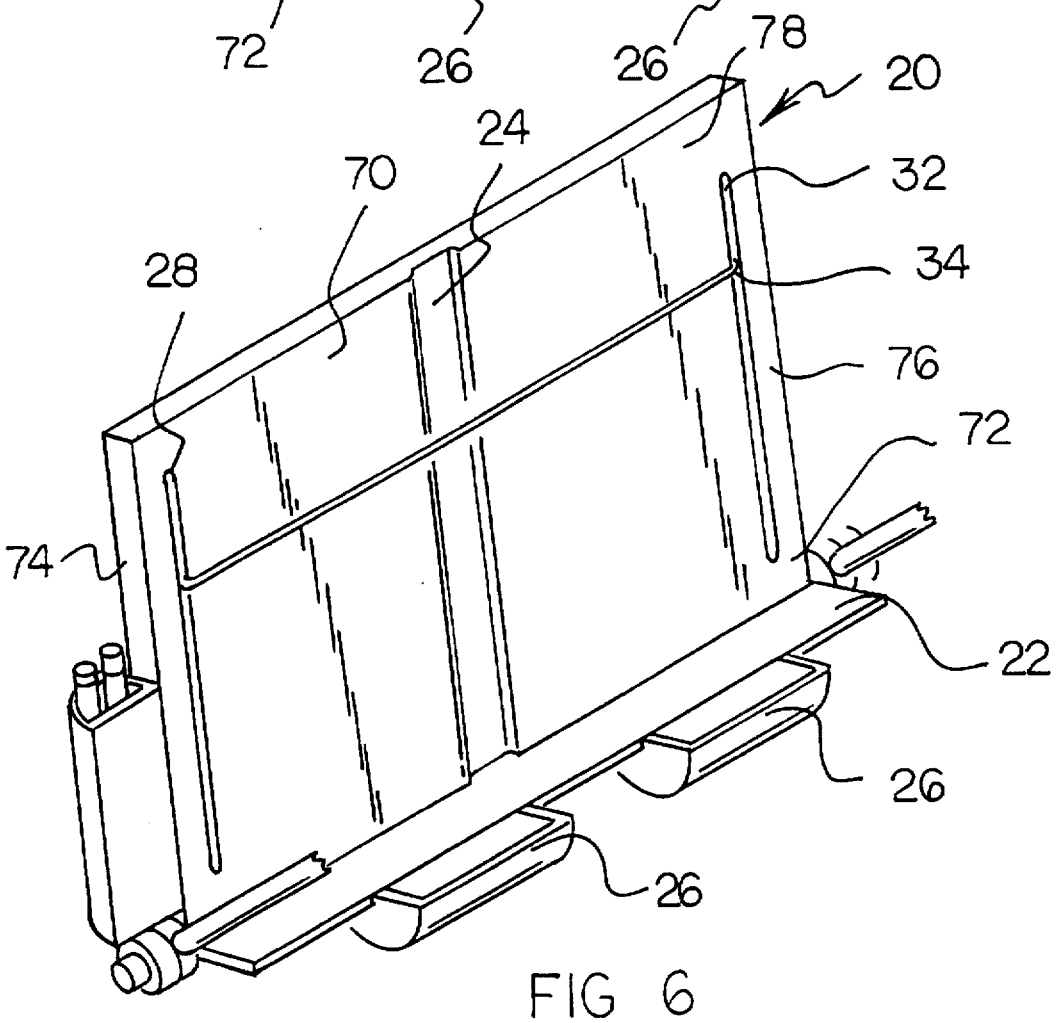
FIG 6

ADJUSTABLE BOOK SUPPORT

BACKGROUND OF THE INVENTION

1. Field of the Invention

The present invention relates to adjustable book supporting device and more particularly pertains to a support for positioning a book at any one of a number of angles.

2. Description of the Prior Art

The use of book supporting devices is known in the prior art. More specifically, book supporting devices heretofore devised and utilized for the purpose of support a book for a user are known to consist basically of familiar, expected, and obvious structural configurations, notwithstanding the myriad of designs encompassed by the crowded prior art which has been developed for the fulfillment of countless objectives and requirements.

By way of example, U.S. Pat. Nos. 4,591,124 to Hellenbrand et al.; 4,020,510 to Fabian; Des. 288,213 to Morales; 4,465,255 to Hill; 4,718,630 to Richard; and 4,017,920 to Sieg all disclose various book supporting devices.

In this respect, the adjustable book supporting device according to the present invention substantially departs from the conventional concepts and designs of the prior art, and in doing so provides an apparatus primarily developed for the purpose of support a book at a number of different angles.

Therefore, it can be appreciated that there exists a continuing need for new and improved adjustable book supporting device which can be used for support a book at a number of different angles. In this regard, the present invention substantially fulfills this need.

SUMMARY OF THE INVENTION

In view of the foregoing disadvantages inherent in the known types of book supporting devices now present in the prior art, the present invention provides an improved adjustable book supporting device. As such, the general purpose of the present invention, which will be described subsequently in greater detail, is to provide a new and improved adjustable book supporting device and method which has all the advantages of the prior art and none of the disadvantages.

To attain this, the present invention essentially comprises a book holding device which is adapted to be secured to the backboard of a bed to enable a user to read hands free. This holding device includes a book supporting platform defined by an upper extent, a lower extent, a first side, a second side, an upper surface and a lower surface. A ledge is secured to the lower extent, and a spine receiving channel is formed intermediate the first and second sides. A pair of lamp assemblies are secured to the ledge and are adapted to illuminate a book secured upon the upper surface of the book supporting platform. Additionally, a first slot is formed within the first side, and a second slot is formed within the second side, and a page securing band is slidably coupled with and serves interconnect the first and second slots. The supporting device also includes two arm assemblies. Each arm assembly includes a minor arm pivotally secured to one of the sides of the book supporting platform. Furthermore, means are included for changing the angular relationship between the minor arm and the book supporting platform. A plurality of adjustment holes are formed within the minor arm. Each assembly further includes a hollow major arm which has a proximal and distal end. The major arm has a plurality of adjustment holes formed therein with each adapted for registration with one of the adjustment holes of the minor arm. The minor arm is slidably received within the proximal end of the hollow major arm, and an adjustment pin is secured within the adjustment holes of the major and minor arms and serving to secure the major and minor arms in telescopic relation, a clamp pivotally secured to the distal end of the major arm, means associated with the distal end of the major arm for adjusting the angular relationship between the clamp and the major arm, the clamp including a C-shaped bracket with in interior surface, the interior surface of the bracket having a cushioning material positioned thereon, a threaded apertures formed through the C-shaped bracket, a bolt having a first end and a second end adjustably positioned within the bracket, the first end of the bolt having a knob formed thereon, a padded engagement member positioned upon the second end of the bracket, the C-shaped bracket adapted to be secured to the backboard of a bed by way of the padded engagement member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved adjustable book supporting device which have all the advantages of the prior art book supporting devices and none of the disadvantages.

It is another object of the present invention to provide new and improved adjustable book supporting device which may be easily and efficiently manufactured and marketed.

It is further object of the present invention to provide new and improved adjustable book supporting device which are of durable and reliable constructions.

An even further object of the present invention is to provide new and improved adjustable book supporting device which are susceptible of a low cost of manufacture with regard to both materials and labor, and which accordingly are then susceptible of low prices of sale to the consuming public, thereby making such adjustable book supporting device economically available to the buying public.

Still yet another object of the present invention is to provide new and improved adjustable book supporting device which provide in the apparatuses and methods of the prior art some of the advantages thereof, while simultaneously overcoming some of the disadvantages normally associated therewith.

Even still another object of the present invention is to support a book at a number of different angles.

Lastly, it is an object of the present invention to provide new and improved a book holding device which enables a user to read in bed without using their hands. In its broadest context, the present invention includes a book supporting platform to which a first and second arm assembly are pivotally attached. Each arm assembly is telescopically arranged to allow for the extension and retraction of the supporting platform. Furthermore, each of the arm assemblies includes a clamp at its distal end. The clamps allow the device to be secured to the backboard of a bed, thus allowing reading in a hands free manner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an elevational view of the support.

FIG. 6 is a perspective view of the book platform.

The same reference numerals refer to the same parts through the various Figures.

DESCRIPTION OF THE PREFERRED EMBODIMENT

Figure 1:
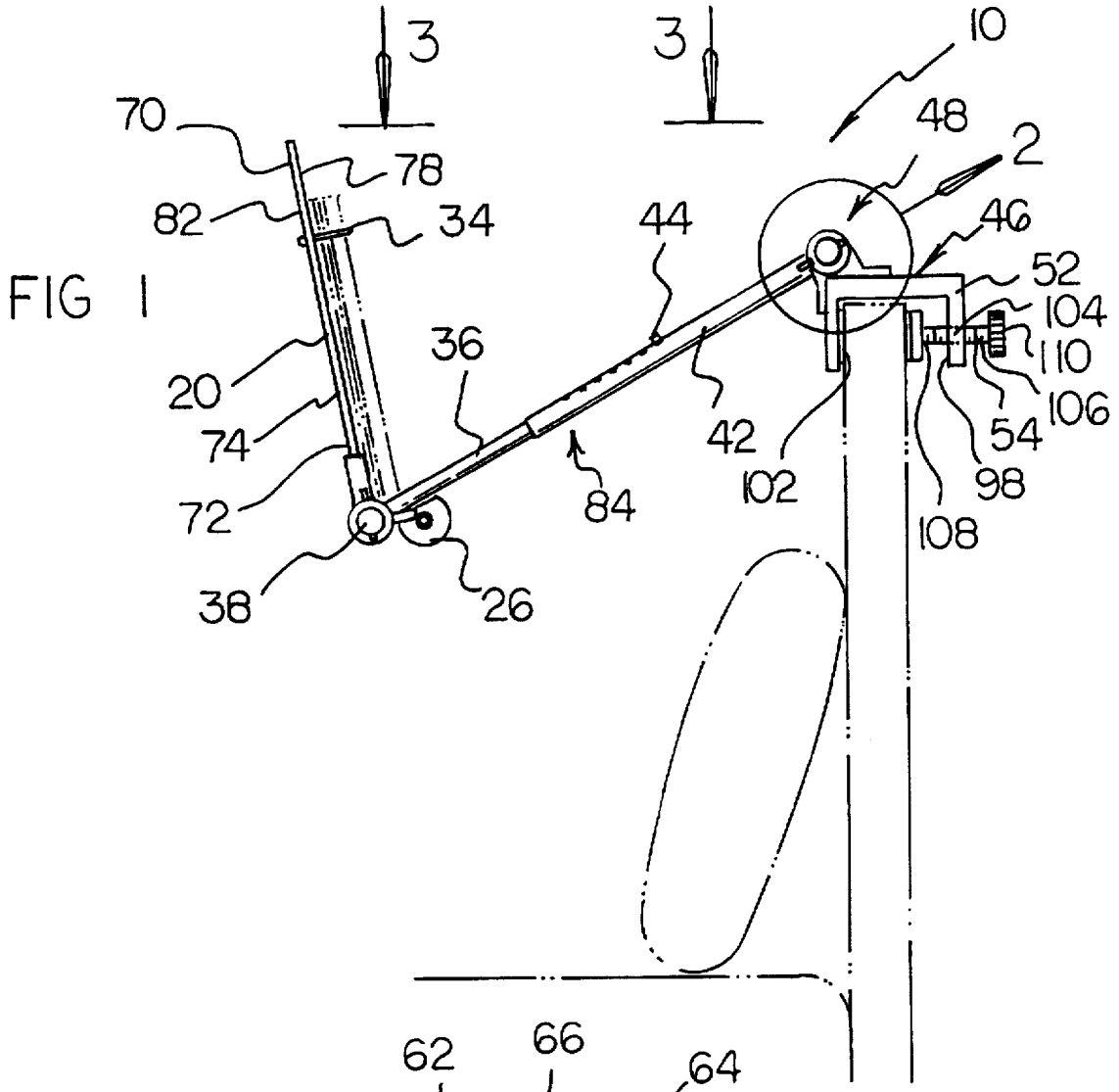
FIG. 1 is a elevational view of the preferred embodiment of the adjustable book supporting device constructed in accordance with the principles of the present invention.
Figure 2:
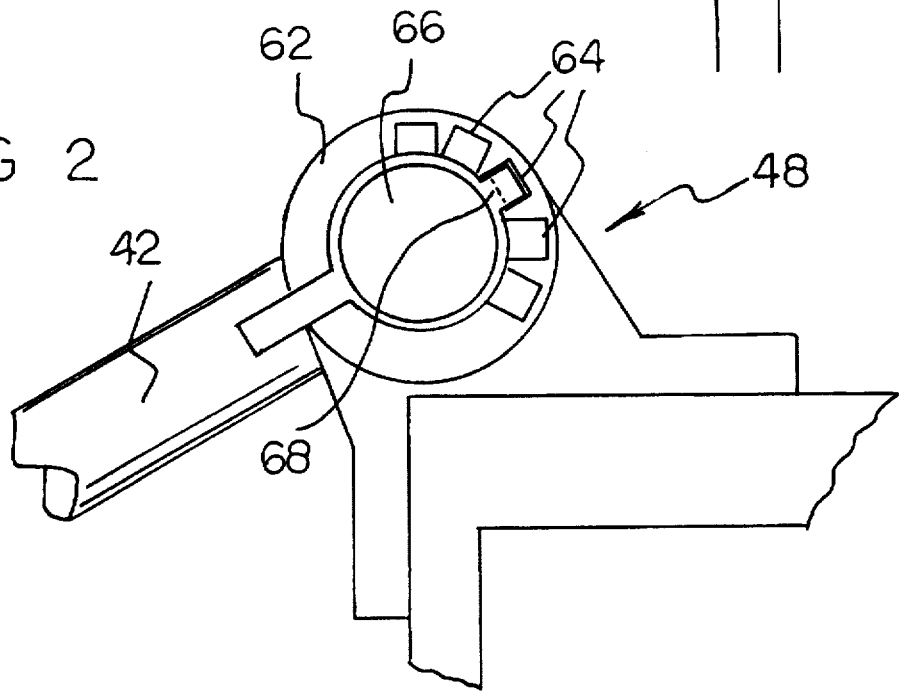
FIG. 2 is an expanded view taken from figure 1.
Figure 3:
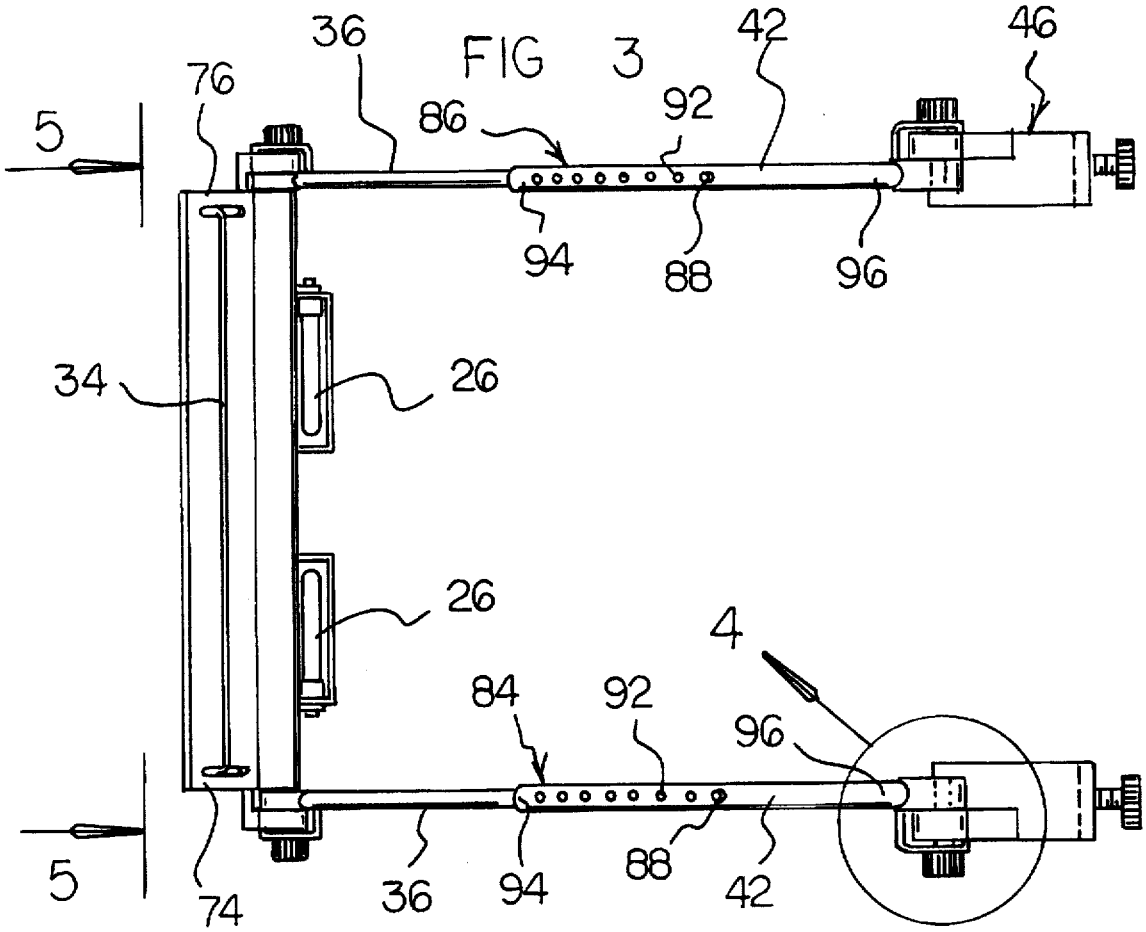
FIG. 3 is a view taken along line 3—3 of FIG. 1.
Figure 4:
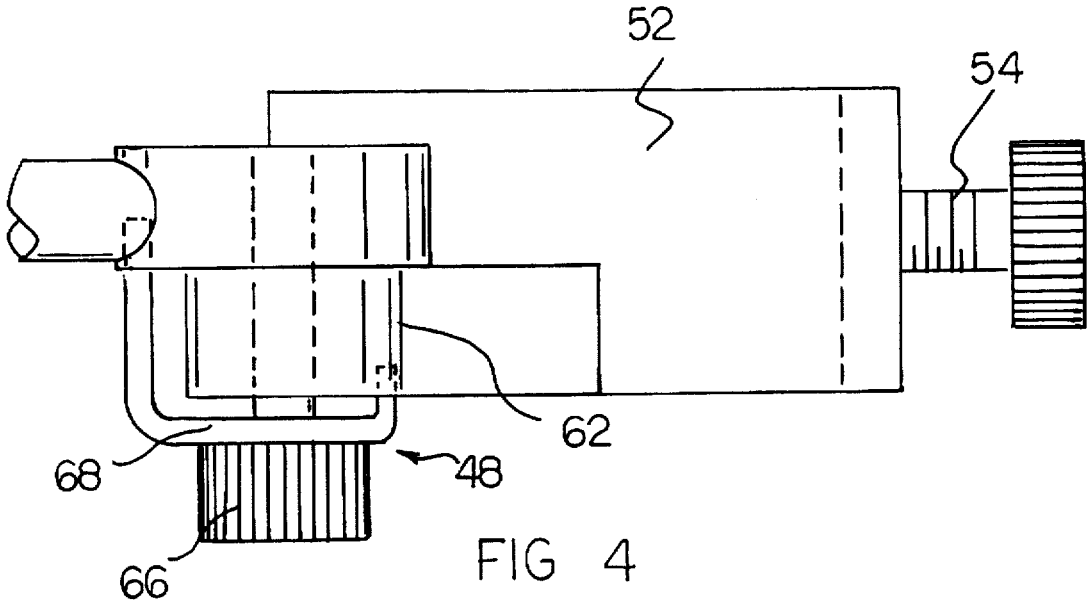
FIG. 4 is an expanded view taken from FIG. 3.

With reference now to the drawings, and in particular to FIG. 1 thereof, the preferred embodiment of the new and improved adjustable book supporting device embodying the principles and concepts of the present invention and generally designated by the reference numeral 10 will be described.

The present invention relates to a book holding device which enables a user to read in bed without using their hands. In its broadest context, the present invention includes a book supporting platform to which a first and second arm assembly are pivotally attached. Each arm assembly is telescopically arranged to allow for the extension and retraction of the supporting platform. Furthermore, each of the arm assemblies includes a clamp at its distal end. The clamps allow the device to be secured to the backboard of a bed, thus allowing reading in a hands free manner. The various components of the present invention, and the manner in which they interrelate, will be described in greater detail hereinafter.

The book supporting platform 20 is defined by an upper extent 70, a lower extent 72, a first side 74, a second side 76, an upper surface 78 and a lower surface 82. These various defining features can best be seen in reference to FIGS. 5 and 6. In order to facilitate the use of the platform 20 as a support, a ledge 22 is secured to the lower extent of the platform 20. Additionally, a spine receiving channel 24 is formed intermediate the first and second sides of the platform 20. This recess is deep enough to allow the spine of a book to rest therein. A pair of lamp assemblies 26 are secured to the ledge 22 and adapted to illuminate a book secured upon the upper surface of the book supporting platform 20. These lamp assemblies 26 are of conventional construction and can be powered either by an external power supply or a battery.

A page securing means is associated with the above described platform 20. This securing means takes the form of a first slot 28 formed within the first side of the platform 20 and a corresponding second slot 32 formed within the second side of the platform 20. Additionally, a page securing band 34 is slidably coupled with, and serves to interconnect, these first and second slots. Thus, the band 34 can be positioned over a book which is supported upon the platform 20. The band 34 functions in keeping the pages of the book from inadvertently turning.

The book platform 20 of the present invention is suspended by way of a first and a second arm assembly 84 and 86 respectfully. The first arm assemblies 84 is pivotally secured to the first side of the platform 20 while the second 86, and identical, arm assembly is pivotally secured to the second side of the platform 20. Since the arm assemblies are identical to one another, only one such assembly will be described in detail.

Each assembly includes a minor arm 36 which is pivotally secured to one of the sides of the book supporting platform 20. Furthermore, means 38 are included for changing the angular relationship between the minor arm 36 and the book supporting platform 20. Additionally, a plurality of adjustment holes 88 are formed within the minor arm 36. The function of these adjustment holes will be described in greater detail hereinafter. A hollow major arm 42 is included in the assembly and is defined by a proximal and distal end 94 and 96 respectfully. The major arm 42 includes a plurality of adjustment holes 92 formed therein each of which are adapted for registration with one of the adjustment holes of the minor arm 36. The minor arm 36 is slidably received within the proximal end of the hollow major arm 42, and an adjustment pin 44 is secured within the adjustment holes of the major and minor arms. This pin serves to secure the major and minor arms in telescopic relation to one another.

Two clamps 46 are employed in securing the arm assemblies, and associated book platform 20, to a headboard. More specifically, a clamp 46 is provided at the distal end 96 of each of the major arms 42. The clamps 46 are identical to one another, consequently, only one such clamp 46 will be described in detail. As indicated, the clamp 46 is pivotally secured to the distal end 96 of the major arm 42. Means 48 are associated with the distal end 96 of the major arm 42 for adjusting the angular relationship between the clamp 46 and the major arm 42. Additionally, the clamp 46 includes a C-shaped bracket 52 with an interior surface 98 onto which a cushioning material 102 is positioned. A threaded aperture 104 is formed through the back wall of this C-shaped bracket 52. A bolt 54, in part defined by a first end 106 and a second end 108, is adjustably positioned within this bracket 52. The first end 106 of the bolt 54 has a knob 110 formed thereon, while the second end 108 has a padded engagement member positioned thereon. The overall arrangement of the clamp 46 is depicted in FIG. 1. Thus, the C-shaped bracket 52 is adapted to be secured to the backboard of a bed. This is achieved by placing the C-shaped bracket 52 over the edge of the backboard and securing it thereon by adjusting the position of the screw relative to the threaded aperture until the padded engagement member contacts the backboard. The interior surface of the bracket 52 and the engagement member are padded to prevent any damage to the backboard.

The means 48 for pivotally relating each major arm distal end to a clamp 46 will next be described. The means 48 takes the form of a stop plate 62 which is fixed to the clamp 46. This stop plate 62 includes an arcuate portion with a number rectangular slots 64 formed therein. The distal end 96 of the major arm includes a threadably interconnected cap portion 66. This cap portion 66 includes an arm stop portion 66 which adapted to be inserted into one of the rectangular slots 64 of the stop plate 62. Thus, the cap portion 66 and major arm 42 are adjusted until the desired angular relationship is achieved between the clamp 46 and major arm 42. Once this relationship is achieved, the stop portion 68 is inserted into the appropriate rectangular slot 64, and the cap 66 is screwed tight relative to the stop plate 62. In the preferred embodiment, the same arrangement is employed between the minor arms 36 and the book platform 20 in the form of adjustment means 38.

As depicted in FIG. 6, a writing implement holder can be employed upon one side of the book platform. This gives the user of the present invention ready access to any desired writing implements.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A book holding device adapted to be secured to a backboard of a bed to enable a user to read hands free, the holding device comprising in combination:

a book supporting platform having an upper extent, a lower extent, a first side, a second side, an upper surface and a lower surface, a ledge secured to the lower extent, a spine receiving channel formed intermediate the first and second sides of the book supporting platform, a pair of lamp assemblies secured to the ledge and adapted to illuminate a book secured upon the upper surface of the book supporting platform, a first slot formed within the first side, a second slot formed within the second side, a page securing band slidably coupled with and interconnecting the first and second slots;

two arm assemblies, each assembly comprising;

a minor arm pivotally secured to one of the sides of the book supporting platform, the minor arm and book supporting platform having an angular relationship means for changing the angular relationship between the minor arm and the book supporting platform, a plurality of adjustment holes formed within the minor arm a hollow major arm having a proximal and distal end, the major arm having a plurality of adjustment holes formed therein each adapted for registration with one of the adjustment holes of the minor arm, the minor arm slidably received within the proximal end of the hollow major arm, an adjustment pin secured within one of the adjustment holes of the major arm and one of the adjustment holes of the minor arm and serving to secure the major and minor arms in telescopic relation, a clamp pivotally secured to the distal end of the major arm, the clamp and major arm having an angular relationship, means associated with the distal end of the major arm for adjusting the angular relationship between the clamp and the major arm, the clamp including a C-shaped bracket with an interior surface a first end and a second end, the interior surface of the bracket having a cushioning material positioned thereon, a threaded aperture formed through the C-shaped bracket, a bolt having a first end and a second end adjustably positioned within the threaded aperture of the bracket, the first end of the bolt having a knob formed thereon, a padded engagement member positioned upon the second end of the bolt, the C-shaped bracket adapted to be secured to the backboard of the bed by way of the padded engagement member.

* * * * *